United States Patent [19]

Masuda et al.

[11] Patent Number: 4,715,870

[45] Date of Patent: Dec. 29, 1987

[54] ELECTROSTATIC FILTER DUST COLLECTOR

[75] Inventors: Senichi Masuda, No. 415, 2-1 Nishigahara 3-chome, Kita-ku, Tokyo 114; Naoki Sugita, Kawaguchi, both of Japan

[73] Assignee: Senichi Masuda, Tokyo, Japan

[21] Appl. No.: 915,929

[22] Filed: Oct. 6, 1986

Related U.S. Application Data

[63] Continuation of Ser. No. 700,113, Feb. 11, 1985, abandoned.

[30] Foreign Application Priority Data

Feb. 18, 1984 [JP] Japan ..... 59-29993

[51] Int. Cl.[4] ..... B03C 3/12; B03C 3/45

[52] U.S. Cl. ..... 55/132; 55/138; 55/141; 55/155; 55/123

[58] Field of Search ..... 55/132, 138, 140, 141, 55/142, 155, 521, 123

[56] References Cited

U.S. PATENT DOCUMENTS 2,297,601 9/1942 Williams ..... 55/132
2,486,521 11/1949 Dahlman ..... 55/138
2,729,302 1/1956 True ..... 55/132
3,397,518 8/1968 Rogers ..... 55/521 X
3,871,851 3/1975 Neumann ..... 55/521
4,357,150 11/1982 Masuda et al. ..... 55/132 X

FOREIGN PATENT DOCUMENTS 892908 4/1962 United Kingdom ..... 55/132

*Primary Examiner*—Kathleen J. Prunner
*Attorney, Agent, or Firm*—Chilton, Alix & Van Kirk

[57] ABSTRACT

This electrostatic filter dust collector has a dust collecting section which is assembled by using a mini-plate type filter member having a small width of the fold thereof and a short distance between the adjacent ridge portions thereof. Since a plurality of insulating spacers are inserted at suitable intervals into the filter member from the upstream and downstream sides thereof, the percentage of the contacting area of the spacers with respect to the filter member is low, and the percentage of the dust collecting area thereof is high. Electrodes are provided on the upstream and downstream ridge portions of the filter member, and a high voltage is applied between these electrodes, so that a uniform and stable electric field is generated on the filter member as a whole. This enables a high dust collecting efficiency to be obtained.

1 Claim, 5 Drawing Figures

ELECTROSTATIC FILTER DUST COLLECTOR

This is a continuation of co-pending application Ser. No. 700,113, filed on Feb. 11, 1985, now abandoned.

SUMMARY OF THE INVENTION

1. Field of the Invention

This invention relates to an electrostatic filter dust collector for use in cleaning dust-containing air and a dust-containing gas.

2. Prior Art

There is a conventional electrostatic filter dust collector using in its dust collecting section a filter medium which consists as shown in FIG. 1 of a filter member 1 of glass fiber folded so as to form ridge portions 2, 3 at the upstream and downstream portions thereof with respect to a direction in which a dust-containing gas flows, and spacers 4, 5 inserted between the opposed surfaces of adjacent ridge portions 2, 3 from the upstream side and downstream side thereof. If the width $d_1$ of the fold of this filter member 1 is reduced, it becomes difficult to keep the filter member 1 and the spacers 4, 5 in the accurate folded position and the accurate inserted positions, respectively, during the assembling of the dust collecting section. This imposed restrictions on the miniaturization and thickness-reduction of the dust collecting section of the filter dust collector. If the distance $d_2$ between the adjacent ridge portions 2, 3 is reduced, the percentage of the contacting area of the spacers 4, 5 with respect to the filter member 1 increases, so that the dust collecting area of the filter member 1 decreases accordingly.

3. Object of the Invention

An object of the present invention is to provide an electrostatic filter dust collector which has smaller dimensions including the thickness and a higher dust collecting efficiency than the above-described conventional electrostatic filter dust collector.

Another object of the present invention is to provide an electrostatic filter dust collector which is used as a high-performance filter for clean benches, clean tunnels and clean zone units, and an air cleaner.

BRIEF DESCRIPTION OF THE DRAWINGS

The above and other objects as well as advantageous features of the invention will become apparent from the following description of the preferred embodiment taken in conjunction with the accompanying drawings.

FIGS. 2–5 show an embodiment of the present invention, wherein:

FIG. 2 is a partially cutaway perspective of a charging section;

FIG. 3 is a partially cutaway perspective of a dust collecting section;

FIG. 4 is an enlarged perspective showing the construction of a filter member; and FIG. 5 is a schematic diagram of the electrostatic filter dust collector in which the dust collecting section is connected to the charging section.

DETAILED DESCRIPTION OF THE INVENTION

Figure 1:
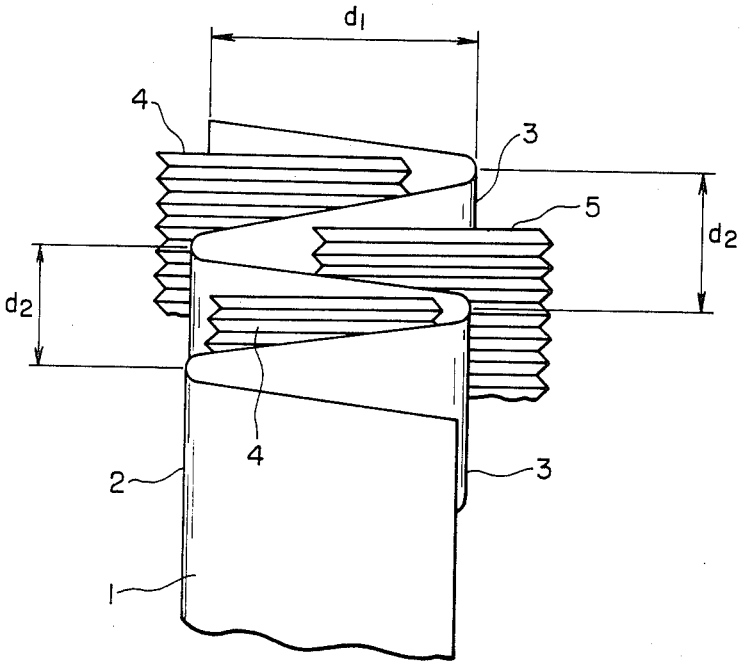
FIG. 1 PRIOR ART
FIG. 1 illustrates how to assemble a dust collecting section of a conventional electrostatic filter dust collector.
Figure 2:
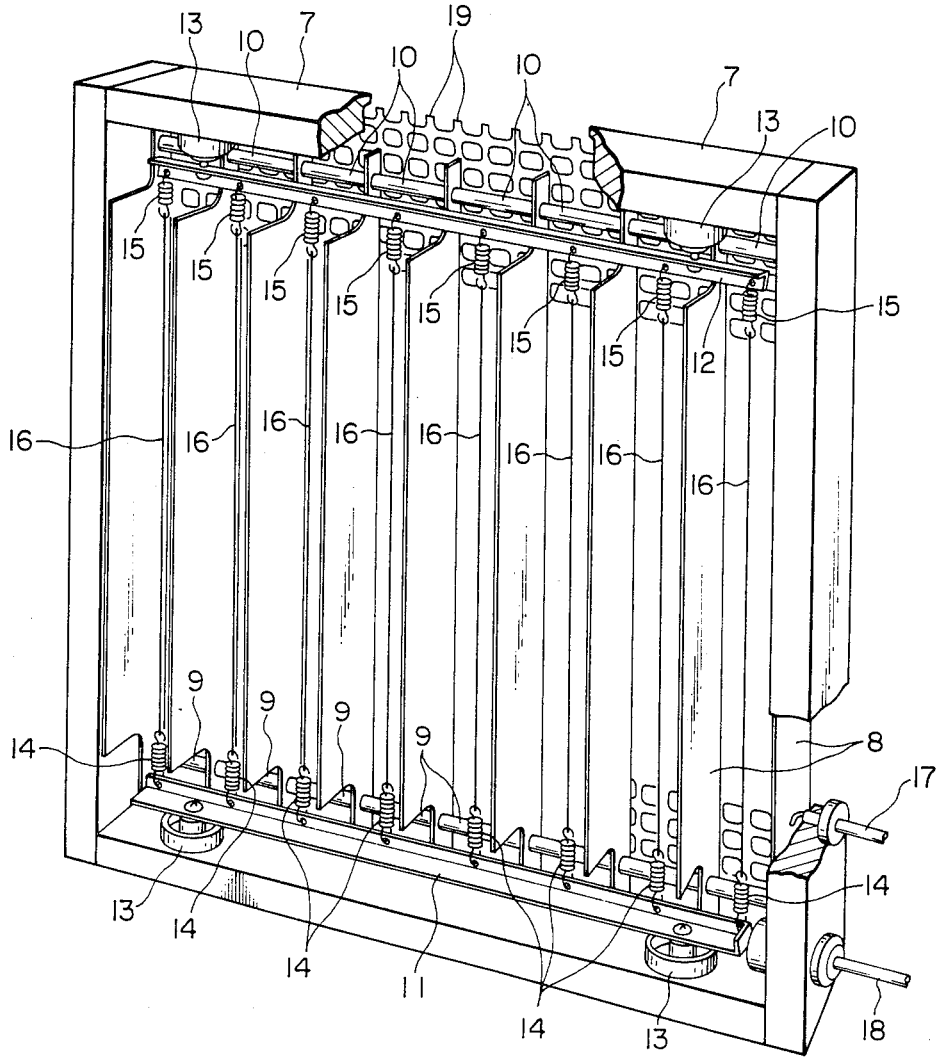
Figure 3:
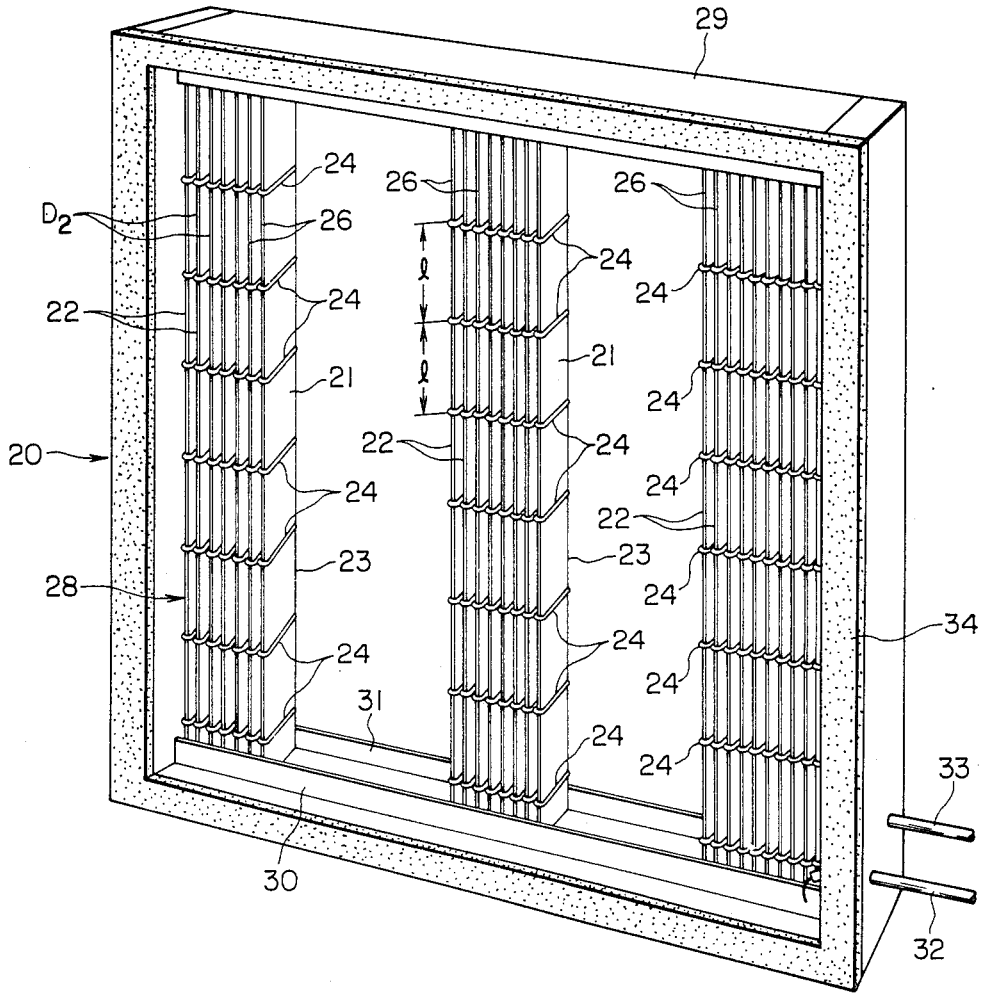
Figure 4:
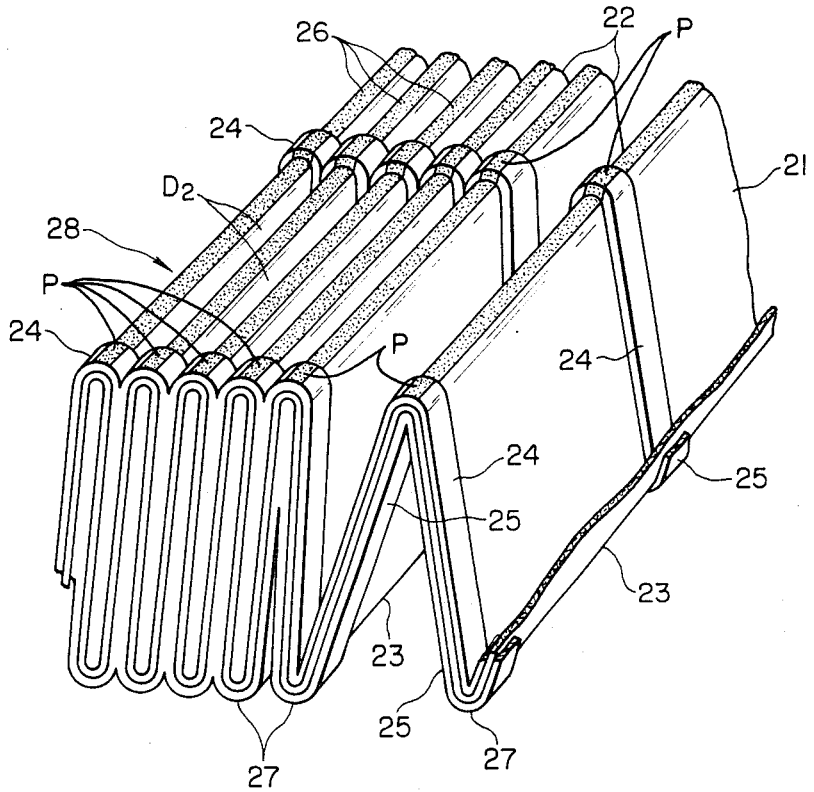

An embodiment of the present invention will now be described with reference to FIGS. 2–5. Reference numeral 6 denotes a charging section, which consists of a frame 7 through which the dust-containing air is passed, a plurality of flat electrodes 8 provided on the inner side of the frame 7 so as to extend at regular intervals and in parallel with the direction in which the dust-containing air flows, conductive spacers 9, 10 provided among narrowed portions formed at both end sections of the flat electrodes 8, conductive support members 11, 12 provided in the spaces defined within the frame 7 by the narrowed portions at both end sections of the flat electrodes 8, seats 13 via which both end portions of the support members 11, 12 are fixed to the frame 7, springs 14, 15 joined to the portions of the support members 11, 12 which are halfway between the adjacent flat electrodes 8, discharge wires 16 provided in a tensed state between the springs 14, 15, a lead wire 17 to be grounded which is connected to the flat electrode 8 positioned near the inner surface of one side member of the frame 7, a high-voltage-applying lead wire 18 connected to the support member 11, and net member 19 having openings of a suitable size and attached to an inlet for the dust-containing air of the frame 7. Reference numeral 20 denotes a dust collecting section to be joined to an outlet for the dust containing air of the charging section 6 having the above-mentioned construction. The dust collecting section 20 consists of a filter member called a mini-pleat type filter member, i.e. a filter member 21 of glass fiber which is folded to a small width $D_1$, for example, not more than 100 mm so as to form alternate ridge portions 22, 23 at the upstream and downstream portions thereof with respect to the direction in which the dust-containing air flows. A plurality of insulating spacers 24, 25 consisting of plastic straps or tapes are inserted into the portions, which are spaced from each other by a suitable distance l, of the spaces defined by the surfaces of adjacent folds of the filter member 21, from the upstream side and downstream side of the same member 21, so as to maintain the distances $D_1$, $D_2$ between the adjacent ridge portions 22, 23 in a low level, for example, at not more than 5 mm, and the spacers 24, 25 are then bonded to the filter member 21. The outer surfaces of the upstream ridge portions 22 and the portions of the upstream spacers 24 which cover these ridge portions 22 in this filter member 21 are coated with conductive paint as shown at P, to form electrodes 26, and the downstream ridge portions 23 and the portions of the downstream spacers 25 which cover these ridge portions 23 with conductive paint to form electrodes 27. A filter 28 thus constructed is fitted in a frame 29 which has the same shape as the frame 7 for the charging section 6, and the circumferential portion of the filter 28 is bonded air-tightly to the inner surface of the frame 29. A current-applying member 30 electrically contacting one end portion of each of the electrodes 26, and a current-applying member 31 electrically contacting one end portion of each of the electrodes 27 are fixed to the frame 29, and lead wires 32, 33, which are used to connect a DC or AC high-voltage device 37 thereto, are connected to these current-applying members 30, 31. Reference numeral 34 denotes a packing attached to such a portion of the frame 29 that is to be joined to the frame 7.

Figure 5:
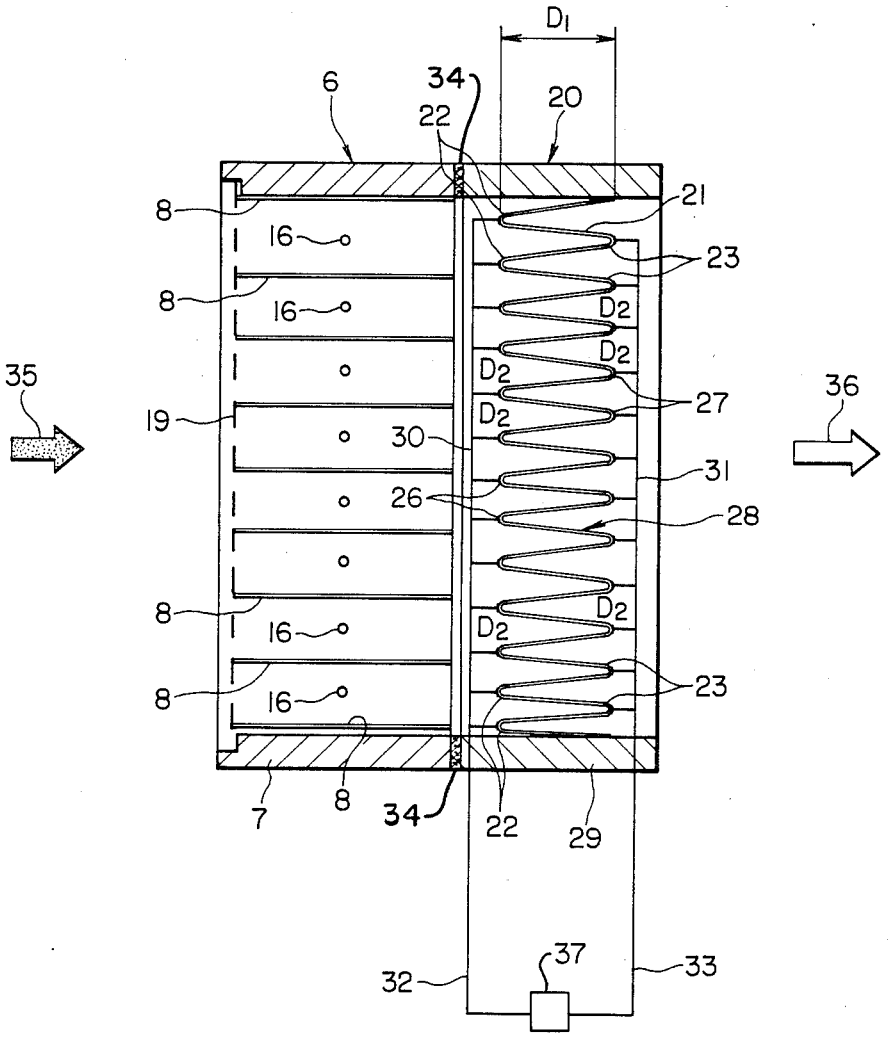

The dust-collecting section 20 constructed as mentioned above is joined by packing 34 to the charging section 6 as shown in FIG. 5. A high voltage is applied to the discharge wires 16 in the charging section 6 to generate corona discharge, and a high voltage between the upstream and downstream electrodes 26, 27 in the dust collecting section 20 to generate a high electric field. The dust-containing air 35 is then introduced into the inlet of the charging section 6 by means of a blower. Consequently, while the dust-containing air 35 passes through the charging section 6, the dust in the air 35 is electrically charged to turn into charged particles. While the dust-containing air 35 thereafter passes through the dust collecting section 20, these charged particles receive the actions of the high electric field between the electrodes 26, 27, and are adsorbed around the fibers of the filter member 21. As a result, the dust-containing air 35 is cleaned, and the resultant clean air 36 is sent out from the outlet of the dust collecting section 20.

The dust collecting section 20 was designed so that the frame 29 had a length of 305 mm, a width of 305 mm and a depth of 50 mm, and the charging section 6 so that the frame 20 had the same sizes as mentioned above. Experiments for determining the dust particle collecting efficiency of a filter dust collector using these dust collecting and charging sections 20, 6 were conducted as the Dop 0.3 $\mu$m dust-containing air is introduced thereinto at a flow rate of 4 $m^3$/min and a pressure loss of 8 mmAq. The following results were obtained.

The dust collecting efficiency measured with no high voltage applied to the dust collecting section was 63%, while the dust collecting efficiency measured with a high voltage applied to the dust collecting section was 99.994%. Namely, it was ascertained that an extremely high dust collecting efficiency can be obtained when a high voltage is applied to the dust collecting section.

The design of the present invention can be varied suitably by, for example, substituting the electrodes 26, 27 in the above embodiment by electrodes using a conductive material other than the conductive paint.

Since the present invention employs a mini-plate type filter member as mentioned above, the width of the fold thereof can be reduced, and the proper folded condition thereof can be retained accurately by the insulating spacers bonded thereto. This enables the thickness-reduced, miniaturized dust collecting section to be assembled simply. Moreover, the distance between the adjacent ridge portions of the filter member is short, and the contacting area of each insulating spacer with respect to the filter member is small. Therefore, the dust collecting area can be increased. The upstream electrodes and the downstream electrodes are spaced by a distance corresponding to the width of the fold of the filter member, i.e., these opposite electrodes are spaced by a sufficiently long insulating distance, so that the insulating of the electrodes can be done easily. Even when a high voltage is applied between these electrodes, an accident does not occur. Even when the humidity is high, a leakage current rarely occurs. Therefore, the stable characteristics of the dust collector can be maintained constantly. Since the distance between the upstream and downstream electrodes is constant, a uniform, high electric field can be generated in the filter member as a whole. Owing to these advantages as well as the large dust collecting area of the filter member, a dust collecting section having such an extremely high dust collecting efficiency as is shown in the results of the above experiments can be obtained. Accordingly, this invention can provide a thin, miniaturized electrostatic filter dust collector having a high dust collecting efficiency and capable of being used as a superhigh performance filter for clean benches, clean tunnels and clean zone units, an air cleaner and various other filtering devices.

We claim:

1. An electrostatic filter dust collector having a charging section through which a dust-containing gas is passed to subject the floating dust particles therein to preliminary electric charging, and a dust-containing section provided with an insulating filter member which is used to collect under the actions of an electric field the charged particles in the dust containing air passed through said charging section, characterized in that:

said charging section and said collecting section are independently framed and the charging section frame and the collecting section frame are joined together by packing;

said insulating filter member is folded so as to form ridges at the upstream and downstream sides thereof alternatively, the distance between said upstream ridges and said downstream ridges being not more than 100 mm;

a plurality of discrete insulating spacers bonded to said filter member at a respective plurality of predetermined, spaced apart levels inside the frame for retaining a distance of not more than 5 mm between the surfaces of the adjacent folded parts of said filter member, each of said spacers extending transversely to the ridges on the upstream and the downstream sides of said filter member and including portions covering said ridges;

said ridges and the portions of the spacers which cover said ridges being coated with a conductive material to form a distinct, continuous electrode spanning each ridge;

a first electrical conducting bar extending transversely in contact with an end portion of each of said electrodes on said upstream ridges and a second electrical conducting bar extending transversely in contact with an end portion of each of said electrodes on said downstream ridges;

means for applying one of either an AC or DC high voltage between said first and second conducting bars, whereby the voltage of each upstream and downstream electrode is established only by said contact with the first and second bars, respectively.

* * * * *

UNITED STATES PATENT AND TRADEMARK OFFICE

CERTIFICATE OF CORRECTION

PATENT NO. : 4,715,870

DATED : December 29, 1987

INVENTOR(S) : Senichi Masuda et al

It is certified that error appears in the above-identified patent and that said Letters Patent is hereby corrected as shown below:

Column 4, line 4 of claim 1, "dust-containing" should be --dust-collecting-- .

Column 4, line 12 of claim 1, insert --a-- before "packing" .

Signed and Sealed this

Fourteenth Day of July, 1992

*Attest:*

DOUGLAS B. COMER

*Attesting Officer*

*Acting Commissioner of Patents and Trademarks*